US007805094B2

(12) United States Patent
Chun

(10) Patent No.: US 7,805,094 B2
(45) Date of Patent: Sep. 28, 2010

(54) IMAGE FORMING APPARATUS AND CHARGE REMOVING DEVICE THEREOF

(75) Inventor: Jin Kwon Chun, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 45 days.

(21) Appl. No.: 12/143,352

(22) Filed: Jun. 20, 2008

(65) Prior Publication Data

US 2009/0074458 A1 Mar. 19, 2009

(30) Foreign Application Priority Data

Sep. 13, 2007 (KR) ..... 10-2007-0092862

(51) Int. Cl.
*G03G 21/00* (2006.01)
*G03G 21/08* (2006.01)

(52) U.S. Cl. ..... 399/128

(58) Field of Classification Search ..... 399/128, 399/129; 361/212, 214, 225; 430/902
See application file for complete search history.

(56) References Cited

U.S. PATENT DOCUMENTS 4,538,905 A * 9/1985 Griego et al. ..... 347/139
2002/0172530 A1 11/2002 Kido et al.
2006/0060751 A1 3/2006 Nishimura et al.
2008/0252887 A1* 10/2008 Honguh ..... 356/338
2009/0060574 A1* 3/2009 Shibata et al. ..... 399/128
2009/0097880 A1* 4/2009 Kawahara et al. ..... 399/128

FOREIGN PATENT DOCUMENTS

JP 60-218687 A * 11/1985
JP 2006-091332 4/2006
JP 2006-113216 4/2006

OTHER PUBLICATIONS

English translation of JP-2006-91332.
English translation of JP-2006-113216.

* cited by examiner

*Primary Examiner*—Sophia S Chen
(74) *Attorney, Agent, or Firm*—Stanzione & Kim, LLP

(57) ABSTRACT

An image forming apparatus and a charge removal device thereof capable of evenly irradiating light to a photosensitive body are disclosed. The charge removal device includes a charge removal lamp, which may be mounted outside the length of the photosensitive body, and the optical axis of which forms an angle with respect to the surface of the photosensitive body, and a lens provided between the photosensitive body and the charge removal lamp. The lens can collimate or make less divergent the light beam emitted by the charge removal lamp, and directs the collimated or less divergent light beam onto the surface of the photosensitive body. The light beam from the lens may be incident upon an area of the surface extending across the length of the photosensitive body.

14 Claims, 6 Drawing Sheets

IMAGE FORMING APPARATUS AND CHARGE REMOVING DEVICE THEREOF

CROSS-REFERENCE TO RELATED APPLICATION

This application claims the benefit of Korean Patent Application No. 10-2007-0092862, filed on Sep. 13, 2007 in the Korean Intellectual Property Office, the disclosure of which is incorporated herein by reference.

BACKGROUND OF THE INVENTION

1. Field of the Invention

The present invention relates to an image forming apparatus, and more particularly, to an image forming apparatus having a charge removal device to remove a residual potential on the surface of a photosensitive body.

2. Description of the Related Art

An image forming apparatus is an apparatus which prints an image on a printing medium, e.g., paper, according to an inputted image signal. Of the various types of image forming apparatuses, an electro-photographic image forming apparatus typically prints an image on paper through paper feeding, developing, transfer, fusing and paper discharge processes. In order to perform the developing process to develop an electrostatic latent image into a visible image on a photosensitive body, an image forming apparatus generally includes a charge roller, a laser scanning device, a developing roller, a cleaning device and a charge removal device.

The photosensitive body is charged to a predetermined electric potential by the charge roller, and the laser scanning device scans light on so charged surface of the photosensitive body charged to form an electrostatic latent image. The developing roller supplies toner to the electrostatic latent image to develop the electrostatic latent image into a toner image, and the toner image thus developed is transferred onto paper. Some residual toner may remain on the photosensitive body after the toner image is transferred onto paper. Such residual toner is removed by the cleaning device.

The charge removal device removes the residual potential remaining on the photosensitive body surface by irradiating light on the photosensitive body, e.g., prior to the next printing process. For example, FIG. 1 schematically illustrates a conventional charge removal device, which may include a plurality of light emitting diode (LED) lamps 2 which are arranged in one or more rows across the longitudinal direction of the photosensitive body 1, each of the LED Lamps facing the latent image forming surface of the photosensitive body.

The above described arrangement of LED lamps 2 may be advantageous in irradiating light evenly on the photosensitive body 1, unfortunately, it may also, however, result in higher cost, and larger size, of the image forming apparatus.

Reductions in the number of LED lamps in an attempt to save cost may result in gaps in the coverage of light between the LED lamps, and thus may adversely effect the uniformity in the light irradiated on the various regions of the photosensitive body surface, which may cause deterioration of the image quality and/or printing defects.

An optical charge removal device disclosed in the US Patent Application Publication No. U.S. 2006/0060751 to Nishimura et al. ("Nishimura") includes a light guide member, which is mounted in parallel with the length of the photosensitive body. The light guide member includes a reflective surface, on which the light emitted from an LED lamp is incident, and which reflects the light onto the surface of the photosensitive body. According to Nishimura, by adequately designing the shape of the reflective surface of the light guide member, it is possible to evenly irradiate light in the axial direction of the photosensitive body.

Unfortunately, however, even in those charge removal devices suggested by Nishimura and others still require a complicated light path from the source of the light, e.g., an LED lamp, to the light guiding member, and in turn reflective path to the photosensitive body. To provide such reflective light path, the device of Nishimura also requires complex light guide member structure and/or the structure of the reflective surface thereof, which in-and-of-itself presents a technical challenge, and which may also contribute to increase in the component costs and/or the size of the image forming apparatus.

In addition, because a mounting space of the light guide member should be provided in the vicinity of the photosensitive body, where many other components for development may already be densely populated, the charge removal device of Nishimura and the likes may cause difficulties in the design and assembly of the image forming apparatus.

SUMMARY OF THE INVENTION

Therefore, it is an aspect of the invention to provide an image forming apparatus and a charge removal device thereof that can evenly irradiate light to a photosensitive body with a reduced number of light sources.

It is another aspect of the invention to provide an image forming apparatus and a charge removal device thereof that can evenly irradiate light to a photosensitive body with a simpler light path structure.

Additional aspects and/or advantages of the invention will be set forth in part in the description which follows and, in part, will be obvious from the description, or may be learned by practice of the invention.

In accordance with an aspect of the invention, there is provided an image forming apparatus comprising: a photosensitive body having a surface on which an electrostatic latent image is to be formed; and a light source disposed within the image forming apparatus such that an optical axis of the light source forms an angle with respect to the surface of the photosensitive body, and such that there is a direct light path from the light sources to the surface of the photosensitive body, the light source being configured to produce a light beam to be incident upon an area of the surface extending across a length of the photosensitive body to remove a charge present on the surface.

The light source may comprise a charge removal lamp configured to produce the light beam that diverges from the optical axis of the light source at a first diverge angle; and a lens disposed in an optical path between the charge removal lamp and the photosensitive body, the lens being configured to receive the light beam from the charge removal lamp, and to direct the light beam with a second diverge angle smaller than the first diverge angle onto the area of the surface of the photosensitive body.

The lens may convert the light beam received from the charge removal lamp into parallel light.

The lens may comprise a spherical lens or a cylindrical lens.

The charge removal lamp may comprise a light emitting diode (LED) lamp.

The light source may be disposed at a first location outside a space between two longitudinal ends of the photosensitive body.

The image forming apparatus may further include a main body defining an exterior appearance of the image forming apparatus, the light source being mounted on the main body.

The image forming apparatus may further include a charge roller configured to charge the surface of the photosensitive body to a predetermined electric potential, the photosensitive body being configured to rotate about a longitudinal axis thereof in a rotational direction, the charge roller being disposed at a second location downstream of the first location with respect to the rotational direction.

In accordance with another aspect of the invention, a charge removal device of an image forming apparatus to remove residual potential from the surface of a photosensitive body may include a charge removal lamp disposed and arranged such that an optical axis of the charge removal lamp forms an angle with respect to the surface of the photosensitive body, and such that there is a direct light path from the charge removal lamp to the surface of the photosensitive body, the charge removal lamp being configured to produce a light beam that diverges from the optical axis at a first diverge angle; and a lens disposed in an optical path between the charge removal lamp and the photosensitive body, the lens being configured to receive the light beam from the charge removal lamp, and to direct the light beam with a second diverge angle smaller than the first diverge angle onto an area of the surface extending across a length of the photosensitive body to remove the residual potential present on the surface.

BRIEF DESCRIPTION OF THE DRAWINGS

These and/or other aspects and advantages of the exemplary embodiments of the invention will become apparent and more readily appreciated from the following description of the embodiments, taken in conjunction with the accompanying drawings, of which.

DETAILED DESCRIPTION OF THE PREFERRED EMBODIMENTS

Figure 1:
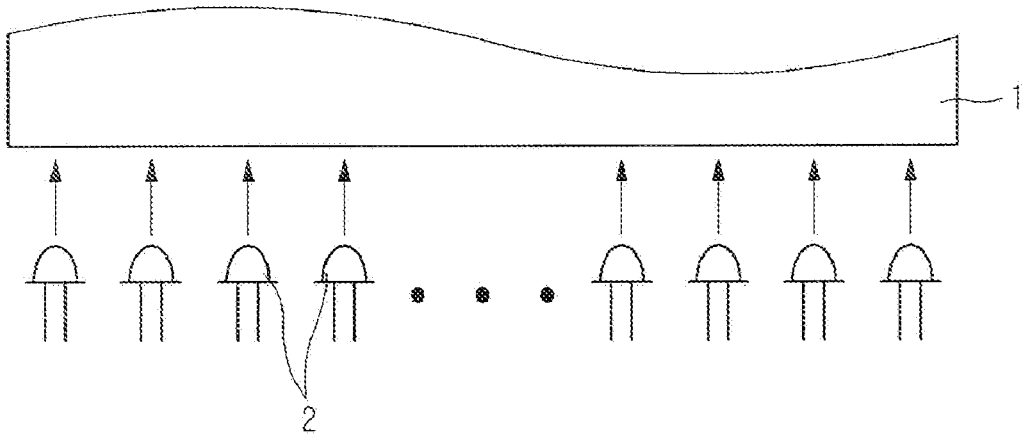
FIG. 1 PRIOR ART
FIG. 1 is a view schematically illustrating an example of a conventional charge removal device.

Reference will now be made in detail to embodiments of the present invention, examples of which are illustrated in the accompanying drawings, wherein like reference numerals refer to like elements throughout. The embodiments are described below to explain the present invention by referring to the figures.

Figure 2:
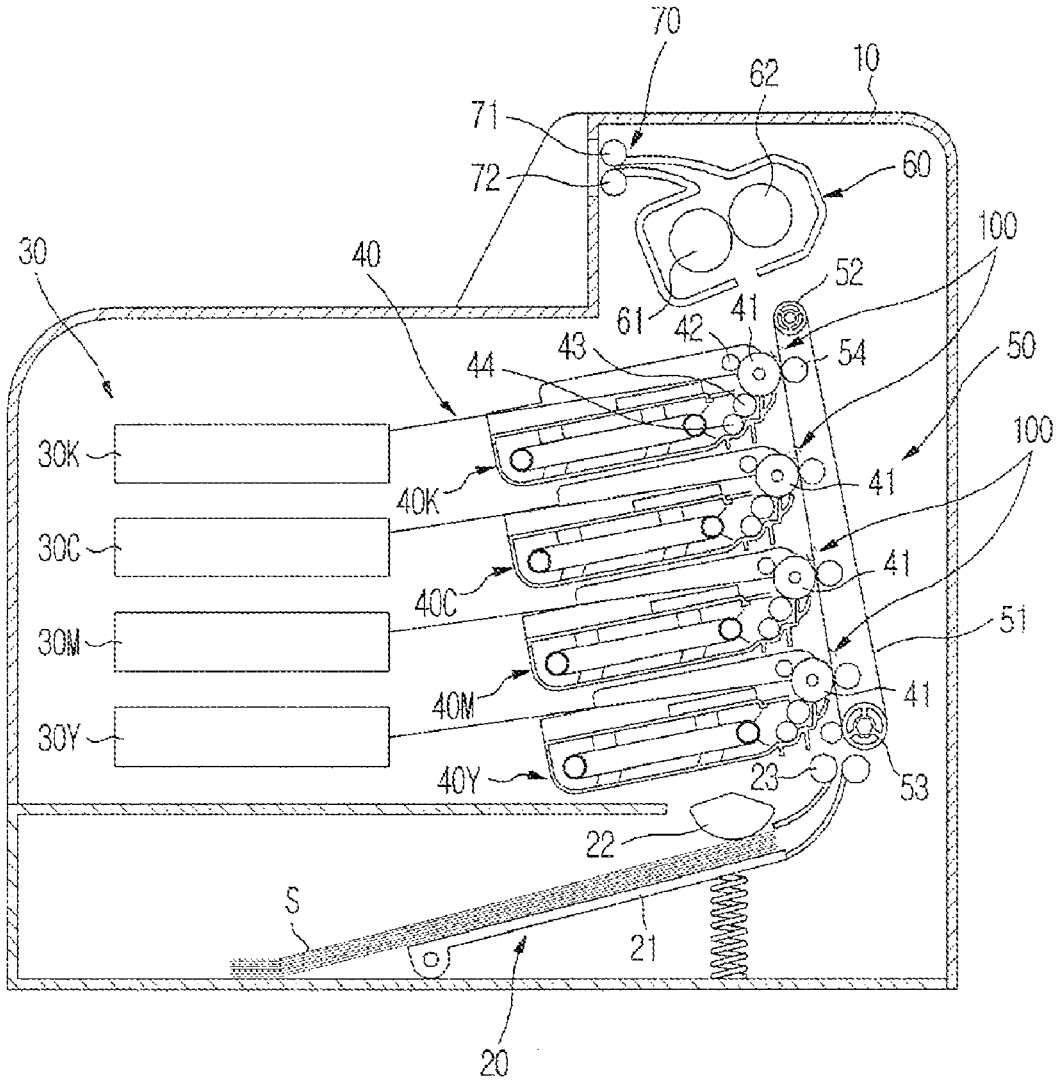
FIG. 2 is a side-sectional view illustrating an image forming apparatus in accordance with an embodiment of the present invention.

FIG. 2 shows the side-sectional view of an image forming apparatus according to an embodiment of the present invention, which may include a main body 10, a paper feeding device 20, an exposure device 30, a developing device 40, a transfer device 50, a charge removal device 100, a fusing device 60, and a paper discharge device 70.

The main body 10 forms an exterior appearance and/or the internal volume of the image forming apparatus, various components of the image forming apparatus may be supported within the internal volume.

The paper feeding device 20 supplies a printing medium, e.g., paper S. The paper feeding device 20 includes a paper tray 21 on which the paper S is loaded, and a pickup roller 22 to pick up the paper loaded on the paper tray 21 one sheet at a time. The paper picked up by the pickup roller 22 is fed to the developing device 40 by a feeding roller 23.

The developing device 40 may include, in the case of a color image forming apparatus, four developing units 40Y, 40M, 40C and 40K, in which toners of different colors, e.g., yellow (Y), magenta (M), cyan (C) and black (K), are respectively contained. The developing units 40Y, 40M, 40C and 40K are respectively provided with photosensitive bodies 41, on surfaces of which electrostatic latent images are formed by the exposure device 30. The exposure units 30Y, 30M, 30C and 30K of the exposure device 30 irradiate light corresponding to image information of yellow, magenta, cyan and black to the photosensitive bodies 41 of the respective developing units according to a print signal. I should be understood that, while in this example of a color image forming apparatus, a multiple, e.g., four, developing units are shown, a monochromatic image forming apparatus that forms a black and white image may include fewer or only one developing unit as is known in the art.

Each of the developing units 40Y, 40M, 40C and 40K includes a charge roller 42 to charge each of the photosensitive bodies 41 to a predetermined electric potential, a developing roller 43 to develop the electrostatic latent image formed on each of the photosensitive bodies 41 into a toner image, and a supply roller 44 to supply the toner to the developing roller 43.

The transfer device 50 transfers the toner image developed on the photosensitive bodies onto the paper. The transfer device 50 includes a transfer belt 51 which circulates while carrying the paper S in contact with the photosensitive bodies 41, a driving roller 52 to drive the transfer belt 51, a tension roller 53 to maintain a constant tensile force of the transfer belt 51, and four transfer rollers 54 to transfer the toner images developed on the respective photosensitive bodies 41 onto the paper.

The fusing device 60 is to apply heat and/or pressure to the image transferred onto the paper so as to fuse the image to the paper. The fusing device 60 may include a heating roller 61 having a heat source to apply heat to the toner image-transferred paper, and a press roller 62 pressed to the heating roller 61 with a predetermined pressure.

The paper discharge device 70 is to discharge the printed paper to the outside of the main body 10. The paper discharge device 70 includes a discharge roller 71, and a discharge backup roller 72 mounted opposite to the discharge roller 71.

When a print command is received, a high voltage is applied to the charge rollers 42, thereby charging the surfaces of the photosensitive bodies 41 at a predetermined electric potential. The exposure units 30Y, 30M, 30C and 30K irradiate light corresponding to image information of yellow, magenta, cyan and black to the photosensitive bodies 41 of the respective developing units, thereby forming electrostatic latent images on the surfaces of the photosensitive bodies 41. The toners in the respective developing units 40Y, 40M, 40C and 40K are supplied to the developing rollers 43 by the supply rollers 44, and the developing rollers 43 in turn apply the toners to the electrostatic latent images formed on the photosensitive bodies 41, thereby forming the toner images of yellow, magenta, cyan and black on the respective photosensitive bodies 41.

The paper S loaded on the paper tray 21 is picked up by the pickup roller 22, and is fed while being placed on the transfer belt 51. While the paper is carried by the transfer belt 51 sequentially past the respective photosensitive bodies 41 and the respective transfer rollers 54, the toner images of yellow, magenta, cyan and black developed on the respective photosensitive bodies 41 are superimposed and transferred onto the paper, thereby forming a color image on the paper.

After the toner images on the respective photosensitive bodies 41 are transferred onto the paper, the charge removal device 100 initializes the surface potential of each of the photosensitive bodies 41 by removing a residual potential remaining on the surface of each of the photosensitive bodies 41. Subsequently, the next printing cycle in the manner described above may be carried out.

While the image forming apparatus according to this embodiment includes four charge removal devices 100 corresponding to the respective photosensitive bodies 41, since all of the charge removal devices 100 may be of the same constitution, a detailed description of any one of them will be sufficient.

Figure 3:
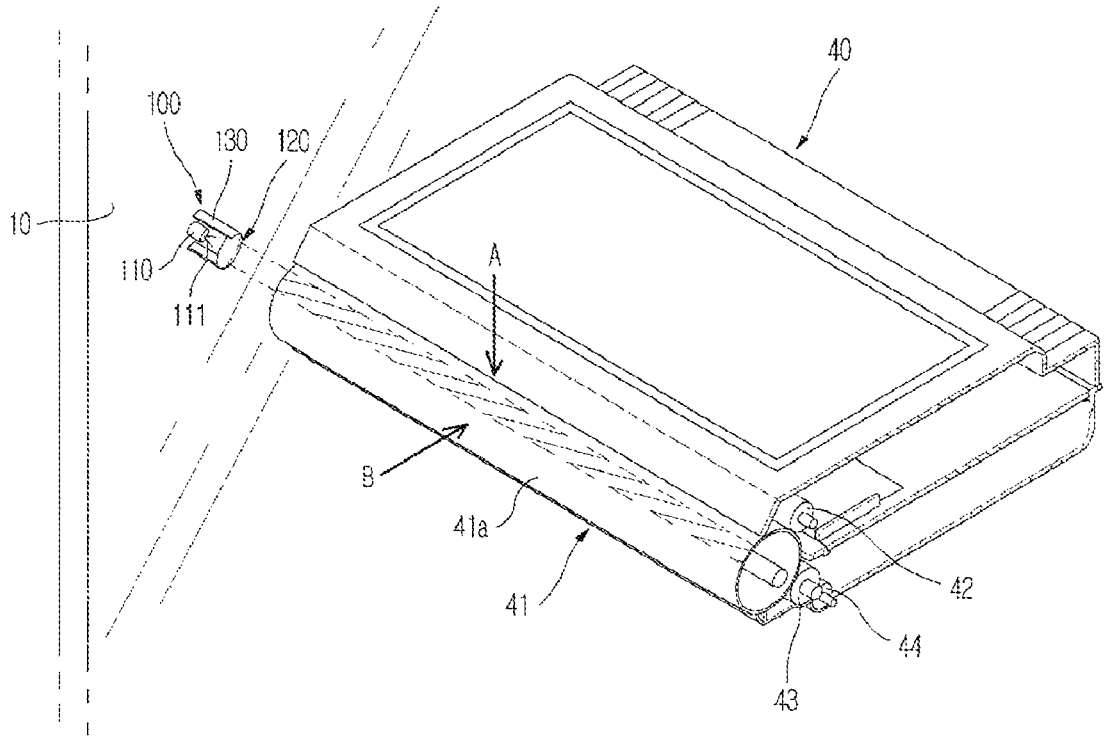
FIG. 3 is a perspective view illustrating constitution of a charge removal device of the image forming apparatus in accordance with an embodiment of the present invention.
Figure 4:
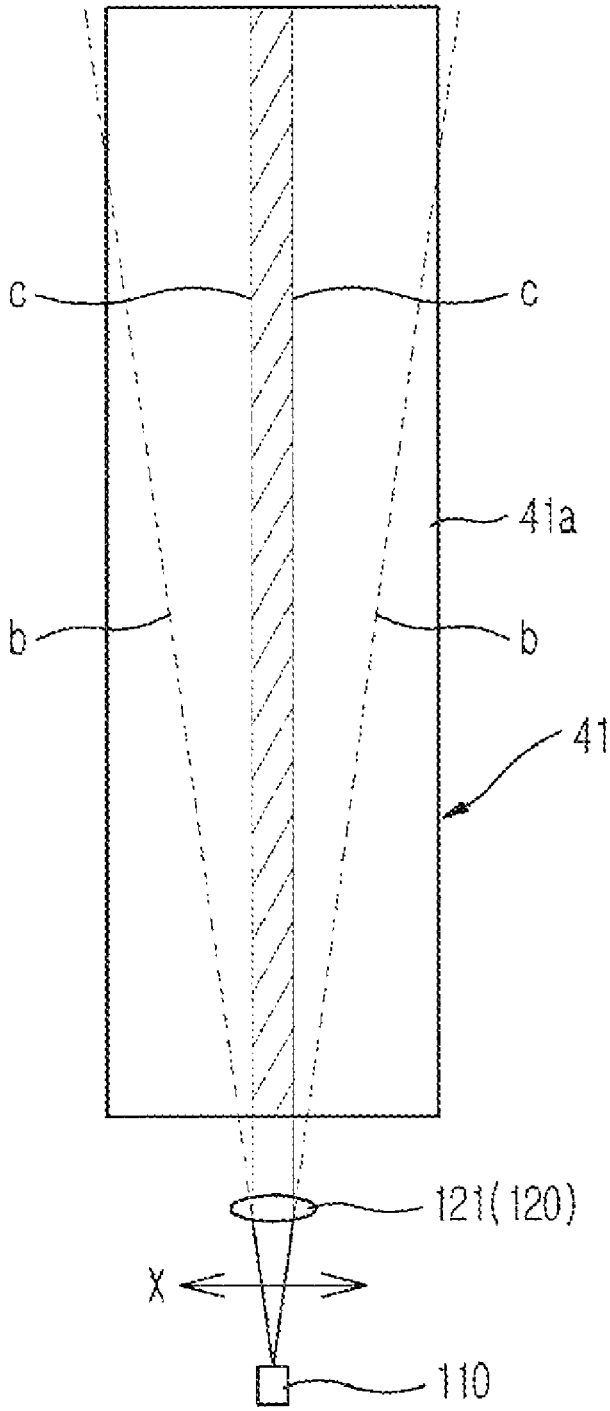
FIG. 4 is a view showing a charge removal device and a photosensitive body in the direction of an arrow A in FIG. 3.
Figure 5:
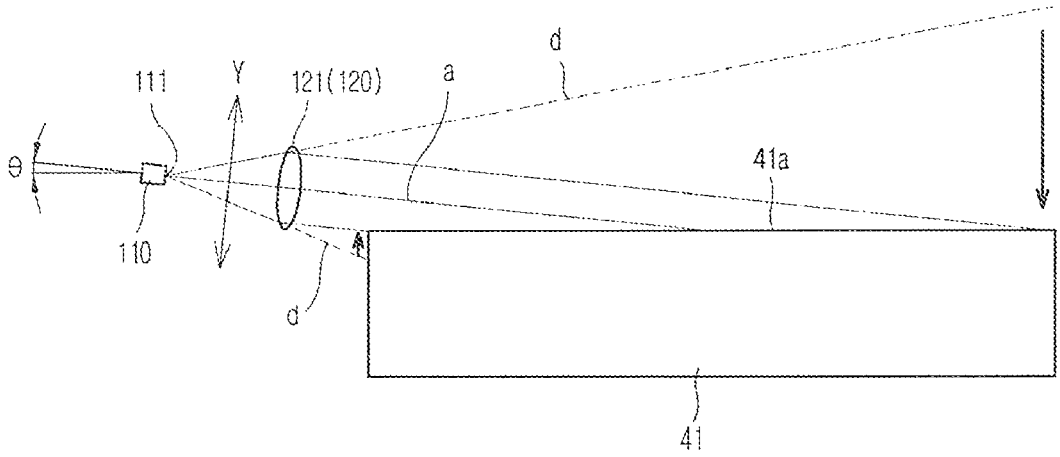
FIG. 5 is a view showing a charge removal device and a photosensitive body in the direction of an arrow B in FIG. 3.

As shown in FIGS. 3 to 5, the charge removal device 100 of the embodiment shown may include a charge removal lamp 110 mounted as a separate component from the photosensitive body 41, which may be a part of the development unit 40 detachable from the image forming apparatus, at a location near and spaced apart from one longitudinal end of the photosensitive body 41. The charge removal lamp 110 may be fixed to the main body 10.

The charge removal lamp 110 is disposed and arranged to irradiate light directly on a portion of the surface 41*a* of the photosensitive body 41. That is, the light emitted from the charge removal lamp 110 becomes incident on the surface 41*a* of the photosensitive body 41 without changing its direction of light path by the use of, e.g., a reflecting device.

The charge removal lamp 110 may be arranged such that the light emitting part 111 (a part of the charge removal lamp through which the light is emitted) faces the photosensitive body at an angle. FIG. 5 illustrates an example in which an optical axis a of the charge removal lamp 110 forms an angle θ with respect to the surface 41*a*. The angle θ is determined based upon factors, e.g., the length of the region of the photosensitive body 41, to which the light from the charge removal lamp is to be irradiated, and the illumination intensity of the light irradiated to the photosensitive body 41. For example, in the case where the angle θ is too large, the light from the charge removal lamp 110 may be incident upon only the portion of the photosensitive body 41 that is closer to the charge removal lamp 110, and may not be incident on portions further from the charge removal lamp 110. On the other hand, in the case where the angle θ is too small, the light from the charge removal lamp 110 may not be irradiated to a portion of the photosensitive body 41 closer to the charge removal lamp 110, or even if the light from the charge removal lamp 110 could cover the entire length of the photosensitive body 41, the illumination intensity of the light received at some portions of the photosensitivity body 41 may be low. It is thus preferable that the angle θ be the largest angle within the range of angles that allows the light from the charge removal lamp 110 to reach the entire region to which the light is intended to be irradiated.

While various types of light sources may be used as the charge removal lamp 110, an LED lamp may preferably used.

As described above, since the charge removal lamp 110 mounted at an longitudinal end of the photosensitive body 41 is able to irradiate light directly on the surface 41*a* of the photosensitive body 41 without requiring, e.g., a reflecting device to change the direction of the light path. There may be, however, in some cases, particularly if the light source produces a divergent light beam, a limitation in irradiating the light across the length of the photosensitive body 41 with uniform illumination intensity because the light may gradually diffuse as it travels away from the charge removal lamp 110, causing the illumination intensity of the light at the region of the photosensitive body 41 closer to the charge removal lamp 110 being relatively higher that the illumination intensity of the light seen at the regions further from the charge removal lamp 110.

Therefore, in an embodiment, a lens 120 may be provided in the optical path between the charge removal lamp 110 and the photosensitive body 41. The lens 120 is disposed adjacent to the charge removal lamp 110, and can be supported by the main body 10 by use of a supporting member 130.

A first end portion of the supporting member 130 is fixed to the main body 10, and a second end portion of the supporting member 130 extends inwardly and toward the photosensitive body 41. The lens 120 may be, for example, fixed to the second end portion of the supporting member 130.

The lens 120 acts to collect the portions of light beam divergent from the optical axis a of the charge removal lamp 110 so that the light becomes focused on a substantially constant area of the surface 41*a* of the photosensitive body 41. Preferably, the lens 120 is designed to behave as a collimating lens to convert the diverging light beam emitted from the charge removal lamp 110 into a parallel light beam.

As shown in FIGS. 3 to 5, the lens 120 may be configured as a spherical lens 121. FIG. 4 shows a state in which the light emitted from the charge removal lamp 110 and diffused along the transverse axis (the X-axis) is collimated by the spherical lens 121. In FIG. 4, the portion indicated by the dashed lines "b" represents the shape of the light beam emitted from the charge removal lamp 110 if the spherical lens 121 were to be absent, and the portion indicated by the solid lines "c" denotes the shape of the light beam after passing through the spherical lens 121, and which is irradiated on the surface 41*a* of the photosensitive body 41. As can be understood from FIG. 4, and from the above description, portions of the divergent light emitted from the charge removal lamp 110 may be refracted (preferably, refracted into parallel light) by passing through the spherical lens 121, and may be substantially uniformly focused on the circumferential surface 41*a* of the photosensitive body. Accordingly, the illuminating intensity of the light irradiated to the surface 41*a* of the photosensitive body 41 can be made substantially uniform across the length of the photosensitive body 41.

FIG. 5 shows a state in which the light emitted from the charge removal lamp 110 divergent in the vertical axis (the Y-axis) is collimated by the spherical lens 121. That is, the light which would not otherwise have reached the surface 41*a* of the photosensitive body 41 due to shape of the light beam emitted from the charge removal lamp 110 (refer to a portion "d") can be directed onto the surface 41*a* of the photosensitive body 41 by the spherical lens 121. Accordingly, most of the light from the charge removal lamp 110 can be made to be incident upon the surface of the photosensitive body 41. As a result, it may be possible to use lesser number of charge removal lamps 110, even when each of which with substantially the same output as each of the charge removal lamps in use in a conventional device to remove the residual potential on the surface of the photosensitive body 41.

Figure 6:
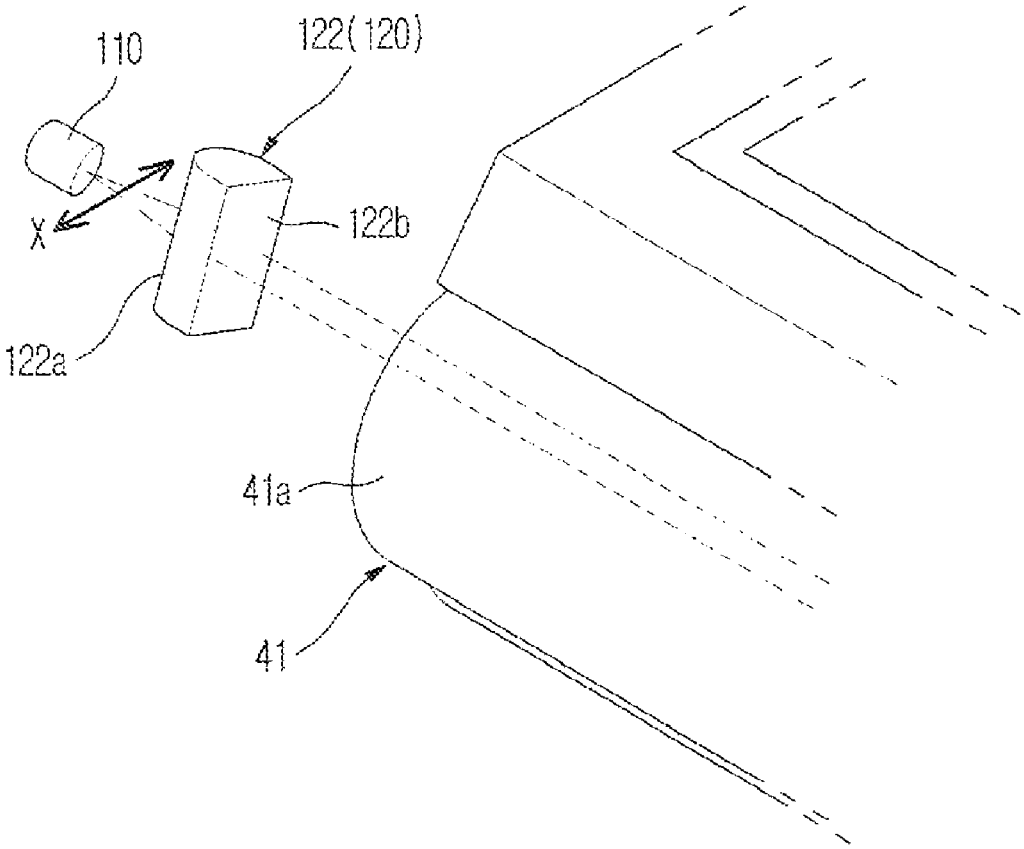
FIG. 6 is a perspective view illustrating an embodiment employing a cylindrical lens.

FIG. 6 is a perspective view illustrating an embodiment in which a cylindrical lens is used in place of the spherical lens. In FIG. 6, the illustration of the main body and the supporting member is omitted, and only a portion of the photosensitive body is illustrated. A mounting structure of the charge removal lamp in this embodiment may be same as the previous embodiment.

In this embodiment, a cylindrical lens 122 is arranged so as to collimate the divergent light (diverging in the transverse axis, i.e., the X-axis) emitted from the charge removal lamp 110. The cylindrical lens 122 includes a curved surface portion 122*a* and a flat surface portion 122*b*. The curved surface portion 122*a* of the cylindrical lens 122 opposes the charge removal lens 110, and the flat surface portion 122*b* is positioned opposite to the curved surface portion 122*a*. The curved surface portion 122*a* of the cylindrical lens 122 has a curvature in the transverse axis direction (the X-axis), but does not have a curvature in the vertical axis (the axis perpendicular to the X-axis) direction.

The cylindrical lens 122 as shown in FIG. 6 collimates the light in a manner similar to the spherical lens 121 shown in FIG. 4, and thereby may direct most of the light emitted from the charge removal lamp 110 onto the circumferential surface of the photosensitive body 41.

As apparent from the above description, the charge removal apparatus according to the embodiments of the present invention can evenly irradiate light on the photosensitive body across the length thereof with lesser number of light sources by providing a direct light path from the light sources to the photosensitive body, the light path forming an incident angle with the surface of the photosensitive body.

In addition, a lens may be provided to direct the diffused light emitted from the light sources onto the desired regions of the photosensitive body. Accordingly, residual potentials on the surfaces of the photosensitive body can be evenly removed, and an image quality can be improved even when light source having a relatively low output is used.

Moreover, components having a large volume or a complicated structure may not be required to be installed in the vicinity of the latent image forming surface of the photosensitive body in order to remove residual potentials therefrom. Accordingly, cost savings and/or reduction of the size of the image forming apparatus can be realized.

Although embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus comprising:

a photosensitive body having a surface on which an electrostatic latent image is to be formed; and a light source disposed within the image forming apparatus such that an optical axis of the light source forms an angle with respect to the surface of the photosensitive body, and such that there is a direct light path from the light source to the surface of the photosensitive body, the light source being configured to produce a light beam to be incident upon an area of the surface extending across a length of the photosensitive body to remove a charge present on the surface.

2. The image forming apparatus according to claim 1, wherein the light source comprises:

a charge removal lamp configured to produce the light beam that diverges from the optical axis of the light source at a first diverge angle; and a lens disposed in an optical path between the charge removal lamp and the photosensitive body, the lens being configured to receive the light beam from the charge removal lamp, and to direct the light beam with a second diverge angle smaller than the first diverge angle onto the area of the surface of the photosensitive body.

3. The image forming apparatus according to claim 2, wherein the lens converts the light beam received from the charge removal lamp into parallel light.

4. The image forming apparatus according to claim 3, wherein the lens comprises a spherical lens.

5. The image forming apparatus according to claim 3, wherein the lens comprises a cylindrical lens.

6. The image forming apparatus according to claim 2, wherein the charge removal lamp comprises a light emitting diode (LED) lamp.

7. The image forming apparatus according to claim 1, wherein:

the light source is disposed at a first location outside a space between two longitudinal ends of the photosensitive body.

8. The image forming apparatus according to claim 7, further comprising:

a main body defining an exterior appearance of the image forming apparatus, wherein the light source is mounted on the main body.

9. The image forming apparatus according to claim 7, further comprising:

a charge roller configured to charge the surface of the photosensitive body to a predetermined electric potential, wherein the photosensitive body is configured to rotate about a longitudinal axis thereof in a rotational direction, the charge roller being disposed at a second location downstream of the first location with respect to the rotational direction.

10. A charge removal device of an image forming apparatus to remove a residual potential from a surface of a photosensitive body, comprising:

a charge removal lamp disposed and arranged such that an optical axis of the charge removal lamp forms an angle with respect to the surface of the photosensitive body, and such that there is a direct light path from the charge removal lamp to the surface of the photosensitive body, the charge removal lamp being configured to produce a light beam that diverges from the optical axis at a first diverge angle; and a lens disposed in an optical path between the charge removal lamp and the photosensitive body, the lens being configured to receive the light beam from the charge removal lamp, and to direct the light beam with a second diverge angle smaller than the first diverge angle onto an area of the surface extending across a length of the photosensitive body to remove the residual potential present on the surface.

11. The charge removal device according to claim 10, wherein the lens converts light beam received from the charge removal lamp into parallel light.

12. The charge removal device according to claim 11, wherein the lens comprises a spherical lens.

13. The charge removal device according to claim 11, wherein the lens comprises a cylindrical lens.

14. The charge removal device according to claim 10, wherein the charge removal lamp comprises a light emitting diode (LED) lamp.

* * * * *